US005927286A

United States Patent [19]

Rea

[11] Patent Number: 5,927,286

[45] Date of Patent: Jul. 27, 1999

[54] CIGAR AND CIGARETTE ASHTRAY

[75] Inventor: Gerald M. Rea, Rochester Hills, Mich.

[73] Assignee: Larry J. Winget, Leonard, Mich.

[21] Appl. No.: 09/075,590

[22] Filed: May 11, 1998

[51] Int. Cl.[6] ..... A24F 19/00

[52] U.S. Cl. ..... 131/241; 131/231; 131/240.1

[58] Field of Search ..... 131/231, 240.1, 131/241

[56] References Cited

U.S. PATENT DOCUMENTS

| | | | |
|---|---|---|---|
| D. 171,120 | 12/1953 | Capouch . | |
| D. 171,527 | 2/1954 | Brown . | |
| D. 172,770 | 8/1954 | Terney . | |
| D. 185,310 | 5/1959 | Norwood | 131/240.1 |
| 1,813,467 | 7/1931 | Smith | 131/240.1 |
| 1,859,516 | 5/1932 | Keyes | 131/240.1 |
| 2,404,174 | 7/1946 | Hines | 131/240.1 |
| 2,410,487 | 11/1946 | Eweson . | |
| 2,424,695 | 7/1947 | Jork . | |
| 2,867,221 | 1/1959 | Farley . | |
| 3,841,339 | 10/1974 | Fox et al. . | |
| 4,060,092 | 11/1977 | Pappas | 131/240.1 |
| 5,542,438 | 8/1996 | Adams et al. | 131/238 |
| 5,657,769 | 8/1997 | Stiller . | |

*Primary Examiner*—James Derrington
*Assistant Examiner*—Michael P. Colaianni
*Attorney, Agent, or Firm*—Brooks & Kushman P.C.

[57] ABSTRACT

A stackable ashtray of rectangular shape is provided in a plastic container having notched walls for supporting cigarettes and outwardly extending channels for supporting cigars.

5 Claims, 1 Drawing Sheet

CIGAR AND CIGARETTE ASHTRAY

TECHNICAL FIELD

This invention relates to ashtrays for supporting cigarettes and cigars in a plastic container configured to be stackable.

BACKGROUND ART

Ashtrays having cigar receiving portions and cigarette receiving portions are shown in the prior art patents to Eweson U.S. Pat. No. 2,410,487, issued Nov. 5, 1946, Jork U.S. Pat. No. 2,424,695, issued Jul. 29, 1947, and Farley U.S. Pat. No. 2,867,221, issued Jan. 6, 1959.

Plastic ashtrays have been found in the foregoing prior art to Farley as well as in Fox et al U.S. Pat. No. 3,841,339, issued Oct. 15, 1974. And glass or ceramic has been used in Stiller's ashtray, U.S. Pat. No. 5,657,769, issued Aug. 19, 1997.

A stackable ashtray is taught in the foregoing prior Fox et al patent. Attention has also been given to the appearance of ashtrays such as seen in the design patents to Capouch, U.S. Pat. No. Des. 171,120, issued Dec. 22, 1953; Brown U.S. Pat. No. Des. 171,527, issued Feb. 23, 1954; and Terney, U.S. Pat. No. Des. 172,770, issued Aug. 3, 1954.

DISCLOSURE OF THE INVENTION

This invention is a cigar and cigarette ashtray. The tray is configured as a container having a cigar-receiving portion, a cigarette-receiving portion, and an ash-receiving portion. The cigarette-receiving portion includes a plurality of notches for holding respectively a plurality of cigarettes. The cigar-receiving portion includes a pair of gusset-reinforced channels, each of which extends outboard of the container for holding a cigar. The ash-receiving portion is in ash-receiving relationship to the ashes on the cigars held respectively in the channels and/or the ashes on the cigarettes held respectively in said plurality of notches. The cigar and cigarette tray of this invention is unitary and formed of temperature-durable plastic. The ashtray is also stackable so that one ashtray may nest within another to conserve space when stored. The overall look of the cigar and cigarette tray is configured to make it stackable and give it a pleasing appearance by placing the cigarette notches within the sides of the container while permitting the cigar-receiving portions to extend outboard of the container from diagonally opposite corners of the container.

Accordingly, it is an object of the present invention to provide an improved plastic cigar and cigarette holder that may be stackable.

Another object of this invention is an improved plastic cigar and cigarette ashtray having a configuration that is pleasing to the appearance.

A more specific object of this invention is to provide an improved cigar and cigarette ashtray in which the cigar holding portions of the ashtray extend outboard of a central ash-receiving portion.

A still more specific object of this invention is the provision of a cigar and cigarette tray which has a container having a cigar-receiving portion, a cigarette-receiving portion, and an ash-receiving portion. The cigarette-receiving portion includes a plurality of notches for holding respectively a plurality of cigarettes. The cigar-receiving portion includes a pair of channels for holding cigars which extend outboard from diagonally opposite corners of said container to provide improved support for the larger cigars. A pair of notches in opposite sides of the cigarette-receiving portion support the smaller cigarettes. The ash-receiving portion is in ash-receiving relationship to the ashes on cigars which are held, respectively, in each of the channels and the ashes on cigarettes which are held respectively in each of the plurality of notches on the ashtray.

The above objects and other objects, features, and advantages of the present invention are readily apparent from the following detailed description of the best mode for carrying out the invention when taken in connection with the accompanying drawings.

DETAILED DESCRIPTION OF THE PREFERRED EMBODIMENT

Figure 1:
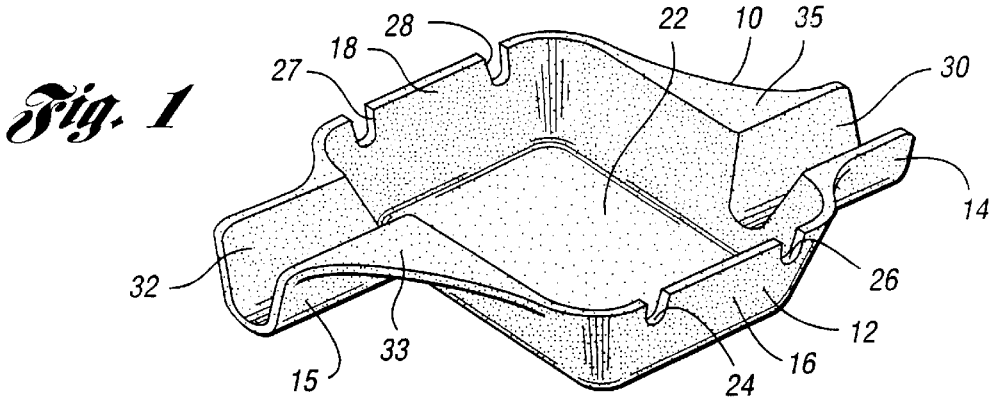
FIG. 1 is a perspective view of the cigar and cigarette ashtray showing the location and appearance of a cigarette-receiving portion and a cigar-receiving portion.
Figure 2:
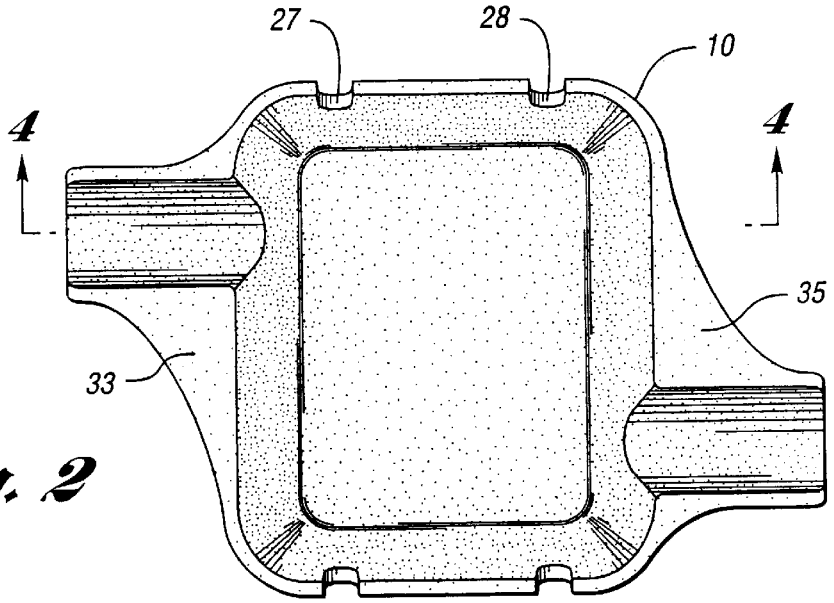
FIG. 2 is a top elevational view of the cigar and cigarette tray.

Referring now to the drawings, the cigar and cigarette ashtray 10 is comprised of a container 12 having cigar-receiving portions 14, 15 and cigarette-receiving portions 16, 18 and an ash-receiving portion 22 therebelow. The cigarette-receiving portion 16 has cigarette-receiving notches 24, 26; the cigarette-receiving portion 18 has cigarette-receiving notches 27, 28; and the cigar-receiving portions 14, 15 have respective cigar-receiving channels 30 and 32. The cigar-receiving portions 30, 32 extend outboard from diagonally opposite corners of the container ash-receiving portion 22 so as to give the ashtray a two-handled appearance; and longer support for the cigar gussets 33, 35 extend outboard alongside channels 32, 30, respectively, to enhance the support of the cigar by the channel.

Figure 3:
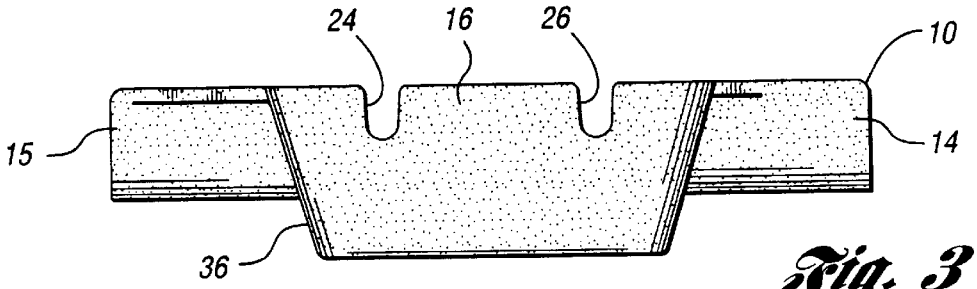
FIG. 3 is a side elevational view of the cigar and cigarette tray.
Figure 4:
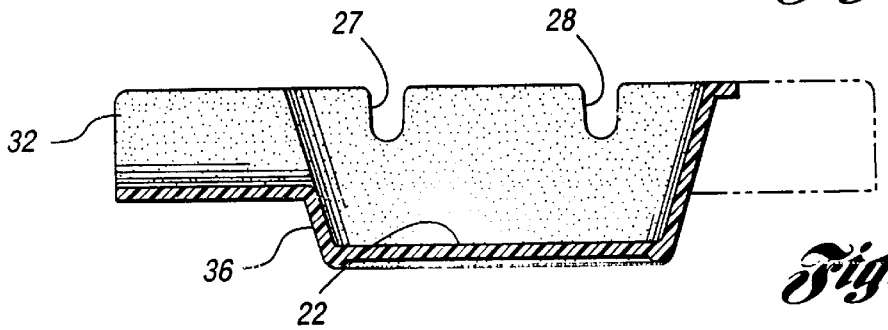
FIG. 4 is a cross-sectional view partly in elevation of the cigar and cigarette tray taken along the line 4—4 in FIG. 2.

Note in FIGS. 3 and 4 that the ash-receiving portion 22 is formed with a flared depression 36 such that a series of ashtrays 10 will nest so as to be stackable, thereby conserving space during storage. Container 12 is formed of a high-temperature durable plastic sufficiently resistant to the heat of the burning ash on cigars and cigarettes to hold the configuration during the life of the product. Suitable material may be phenolic or high heat acrylonitrile/butadiene/styrene copolymer (ABS).

It is recognized that many modifications of this ashtray may be made from non-heat conductive materials used in the relative angles of the support portion. I have set forth the preferred embodiment of the invention and am aware that modifications can be made without departing from the spirit of the invention as defined by the following claims.

What is claimed is:

1. A cigar and cigarette ashtray comprising:

a container having a cigar-receiving portion, a cigarette-receiving portion, and an ash-receiving portion;

said cigarette-receiving portion including a plurality of notches for holding respectively a plurality of cigarettes;

said cigar-receiving portion having at least one channel for holding a cigar and extending outboard of the periphery of said container; and said ash-receiving portion being in ash-receiving relationship to ashes on a cigar held in said channel and ashes on cigarettes held respectively in said plurality of notches and being formed with a flared depression such that a series of ashtrays having the at least one outboard channel and flared depression respectively nest so as to be stackable for conserving space.

2. The cigar and cigarette ashtray of claim 1 wherein said container has four flaring sides surrounding said ash-receiving portion to form the flared depression, two of said four sides including said plurality of notches oppositely disposed to each other in said cigarette-receiving portion, and two others of said four sides each having at least one channel for holding a cigar diagonally oppositely disposed to each other in said cigar-receiving portion and extending outboard of the periphery of said container.

3. The cigar and cigarette ashtray of claim 1 including a gusset for supporting and strengthening said channel where the channel extends outboard of the periphery of said container.

4. A cigar and cigarette ashtray comprising a container made of an integrally formed, heat-resistance thermoplastic, and having a cigar-receiving portion and a cigarette-receiving portion; and an ash-receiving portion in ash-receiving relationship to said cigar-receiving portion and said cigarette-receiving portion;

said container including a plurality of notches in said cigarette-receiving portion and coplanar therewith and sufficiently small to grip and retain the cigarette over said ash-receiving portion, said container having at least one channel in said cigar-receiving portion extending outboard of the periphery of said container sufficiently to support and retain the cigar over said ash-receiving portion and said ash-receiving portion being formed with a flared depression such that a series of said ashtrays having the at least one outboard channel and flared depression respectively nest so as to be stackable for conserving space.

5. The cigar and cigarette ashtray of claim 4 wherein said cigar-receiving portion includes a gusset extending outboard from the periphery of said container alongside said channel to enhance the support of the cigar by said channel.

* * * * *